US005823704A

United States Patent [19]

Koch et al.

[11] Patent Number: 5,823,704

[45] Date of Patent: Oct. 20, 1998

[54] HOLDING DEVICE FOR THE ANCHORAGE OF SINGLE- OR MULTILAYER WEBS TO A STATIONARY STRUCTURAL MEMBER

[75] Inventors: Hans-Jürgen Koch; Klaus-Michael Koch, both of Rimstring, Germany

[73] Assignee: Koch Konstruktive Membranen GmbH & Co., K.G., Rimsting, Germany

[21] Appl. No.: 700,445

[22] PCT Filed: Jan. 3, 1996

[86] PCT No.: PCT/EP96/00006

§ 371 Date: Dec. 13, 1996

§ 102(e) Date: Dec. 13, 1996

[87] PCT Pub. No.: WO96/21072

PCT Pub. Date: Jul. 11, 1996

[30] Foreign Application Priority Data

Jan. 3, 1995 [DE] Germany ..... 295 00 055 U

[51] Int. Cl.[6] ..... F16B 2/02

[52] U.S. Cl. ..... 403/396; 403/391; 52/2.11; 52/273

[58] Field of Search ..... 403/396, 217, 403/218, 219, 389, 390, 391, 375, 169, 170, 178; 138/135, 121, 124; 52/81.3, 273, 63, 222, 2.11

[56] References Cited

U.S. PATENT DOCUMENTS

| | | | |
|---|---|---|---|
| 3,240,217 | 3/1966 | Bird et al. | 135/124 X |
| 3,323,820 | 6/1967 | Braccini | 52/81.3 X |
| 3,791,076 | 2/1974 | Gahler | 135/124 X |
| 3,811,454 | 5/1974 | Huddle | 135/1 R |
| 3,909,994 | 10/1975 | Richter | 52/81.3 X |
| 4,036,244 | 7/1977 | Huddle | 52/63 |
| 4,092,992 | 6/1978 | Huddle | 52/63 X |
| 4,192,112 | 3/1980 | Reilly, Sr. | 52/222 |
| 4,194,851 | 3/1980 | Littlefield | 403/218 |
| 4,280,769 | 7/1981 | Ceglowski | 403/218 |
| 4,608,790 | 9/1986 | Eberlein et al. | 52/81.3 |
| 4,817,655 | 4/1989 | Brooks | 135/121 |
| 4,838,294 | 6/1989 | Hunt | 135/124 |
| 4,886,084 | 12/1989 | Lawrence et al. | 135/103 |
| 5,069,572 | 12/1991 | Niksic | 403/218 X |
| 5,328,286 | 7/1994 | Lee | 403/218 |

FOREIGN PATENT DOCUMENTS

| | | | |
|---|---|---|---|
| 0 389 104 A1 | 2/1990 | European Pat. Off. . | |
| 2236071 | 1/1975 | France | 52/222 |
| 2 544 778 | 4/1983 | France . | |
| 21 22 167 A1 | 5/1971 | Germany . | |
| 2302500 | 7/1973 | Germany | 52/63 |
| 39 42 607 A1 | 12/1989 | Germany . | |
| 4326471 | 2/1995 | Germany | 52/222 |

*Primary Examiner*—Harry C. Kim
*Attorney, Agent, or Firm*—Pretty Schroeder & Poplawski

[57] ABSTRACT

The invention relates to a holding device (1) by which preferably multilayer cushions inflatable by air pressure can be fixed to a structural member, e.g. for producing a light-permeable and heat-insulating ceiling. For this purpose, the holding device (1) according to the invention comprises one or several piping profiles (4, 5) for receiving a peripheral thickening (42) of the cushions (2, 3). After the peripheral thickening has been fixed, the piping profiles (4, 5) are located in one or several receiving spaces (8, 9) of the supporting profile (6). In order to secure the piping profiles (4, 5) against loss a top profile (7) is fixed to the supporting profile (6).

12 Claims, 1 Drawing Sheet

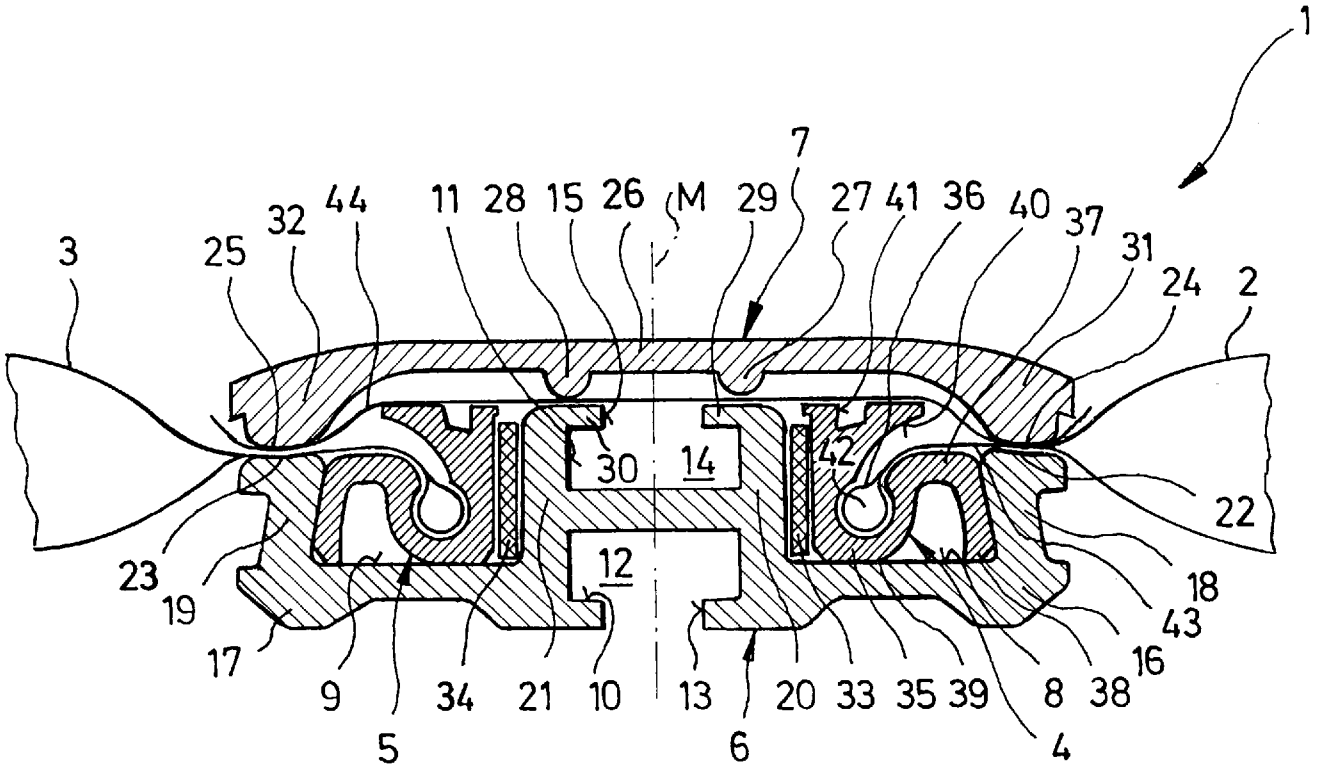
1
2
3
4
5
6
7
8
9
10
11
12
13
14
15
16
17
18
19
20
21
22
23
24
25
26
27
28
29
30
31
32
33
34
35
36
37
38
39
40
41
42
43
44
M

HOLDING DEVICE FOR THE ANCHORAGE OF SINGLE- OR MULTILAYER WEBS TO A STATIONARY STRUCTURAL MEMBER

BACKGROUND OF THE INVENTION

The invention relates to a holding device for the anchorage of single- or multilayer webs to a stationary structural member according to the preamble of claim 1. The invention furthermore relates to a process for anchoring such webs, in particular in the form of air-cushions, to structural members.

From DE-OS 21 22 167 a generic holding device is known by means of which a single-layer web provided with a peripheral thickening can be anchored. Said web can also be called a membrane. In this context a membrane is a structural member consisting of flexible and optionally reinforced plastic material that can e.g. be used for forming roof surfaces. The bead-like peripheral thickening of such membranes is called a piping rim. In addition to single-layer webs, it is also possible to form the webs in particular in a two-layer form, whereby the edges are closed in an air-tight manner. Such two-layer webs can be inflated with air, thus forming cushions, which are mainly used as structural parts for roofs and walls. This kind of cushion has the advantage of being of low weight compared to glass, while being just as light-permeable as glass. This kind of air-filled cushion also has the advantage of guaranteeing a good thermal insulation.

Particularly for the anchorage of such cushions there is merely a construction known so far wherein a holding device usually consisting of aluminum is shaped in a manner that it embraces the piping rim, thus positioning the cushion to a primary structure after fixing. However, the main disadvantage of this construction resides in the fact that the holding device cannot be opened and closed as frequently as desired, as the material will break.

It is therefore the problem of the present invention to provide a holding device for the anchorage of single- or in particular multilayer webs to a stationary structural member, allowing a simple assembly and disassembly of the webs at low costs.

This problem is solved by the holding device of the present invention.

SUMMARY OF THE INVENTION

With the holding device according to the invention single-layer webs in the form of membranes provided with a piping rim or also multilayer webs, in particular in the form of the above mentioned air cushions, can be mounted to optional primary structures, like walls, scaffoldings or roof sections, in a most simple and economical manner. It is merely necessary to fix the peripheral thickening or the piping of the web or the cushion in the piping profile and, thereafter, to arrange the piping profile in a receiving space of a girder profile, without requiring a deformation of the profiles or the use of particularly expensive tools.

The holding device according to the invention has the further advantage to consist of individual elements that can be produced easily and economically, that can be exchanged against each other also after the assembly of the holding structure, e.g. when one of the parts is defective.

There also results the advantage of a self-supporting structure which must be supported, on average, only every two meters.

The preferred materials for the holding device are aluminum or glass-fiber reinforced plastic materials (GFK).

It is preferred that the holding device is provided with a top profile which is fixed to the girder profile by means of the web attached to the piping profile, after the piping profile has been inserted. Thus it is possible to additionally secure the piping profile arranged in the receiving space of the girder profile against sliding out, as the receiving space is closed after the top profile has been attached. For fixing the top profile to the girder profile the use of a screwed connection is preferred, which extends through the top profile and engages into a groove at the girder profile. In order to avoid the penetration of dust and water, the screw either is a sealing screw or additional screws are provided in the area of the passage through the top profile.

In order to achieve at least temporary fixing of the piping profile in the receiving space a locking plate is provided which is inserted between the piping profile arranged in the receiving space and an internal border wall of the receiving space. Depending on the kind of load applied by the web, such a locking plate can prevent the dropping out of the piping profile even without providing the top profile. However, it is preferred to provide a top profile, as in this case the piping profile is secured perfectly. The above mentioned temporary locking with the locking plate refers to the fixing of the piping profile prior to the attachment of the top profile, wherein the locking plate can remain in the receiving space also after the top profile had been fixed.

It is a further preferred embodiment that the holding device comprises clamping means arranged adjacent to the receiving space wherein the piping profile is positioned. It is preferred that said clamping means is formed by two clamping surfaces arranged one on top of the other, the one of which is arranged at the top profile and the other one of which is arranged at the supporting profile. The clamping surface of the top profile is positioned in the edge area of the top girder and, in an assembled state, points to the corresponding opposite clamping surface of the supporting profile or an exterior border wall thereof. In an assembled state, the clamping surfaces of the clamping means fix the area of the welded seam of the fixed double-layer web, which is inflated with air to become a cushion. The action of the clamping means produces the effect that the peeling effect exerted on the welding seam by the air pressure is compensated, i.e. the welding seam is not undone by the air pressure.

In a further particularly preferred embodiment a film for sealing and for distributing the pressure is inserted between the top profile and the girder profile, which film, after the insertion of the piping profile into the receiving space, will cover the piping profile and the welding seam area located in the clamping means. It is preferred that the sealing and pressure-distributing film is made of plastic material and allows an additional sealing of the entire device as well as a pressure distribution after the attachment of the top profile.

It is also preferred that that surface of the piping profile which, when assembled, faces the top profile is provided with a groove as an assembling aid. Into said groove appropriate tools can be placed to hold the piping profile and to insert same into the receiving space.

For fixing the girder profile to the structural member or to the primary structure it is preferred to provide a screwed connection which engages a groove of the girder profile and which can consist of a plurality of screws, if desired, the heads of which engage the groove and are fixed to the primary structure at the side of their threading, by means of nuts.

Basically it is possible that the holding device merely comprises one receiving space for the arrangement of a piping profile. In a particularly preferred embodiment the holding device according to the present invention, however, is of symmetrical structure and comprises two opposing receiving spaces arranged symmetrically to its center line. In this embodiment, the holding area for the top profile and the fixing means at the primary structure is located between the two receiving spaces.

The invention also relates to a process for the anchorage of webs to a primary structure or a structural member and teaches in particular a process using air-filled cushions, which can form e.g. a light-permeable ceiling or wall. According to the process of the invention the supporting profile is first fixed to the primary structure (walls, scaffoldings and the like), preferably by means of a screwed connection, for forming such a structure. After the girder profile has been fixed, the piping profile is moved over the peripheral thickening of the web or the cushion in such a manner that the peripheral thickening comes to rest in a retaining recess of the piping profile and thus can no longer slide out thereof. The thus formed unity of piping profile and web fixed thereto is defined in the receiving space of the supporting girder by vertically lowering and engaging the piping profile together with the edge area of the cushion. Following this process step, it is preferred that the piping profile is fixed temporarily by arranging the above described locking plate, in order to prevent it from falling out. It is a further particularly preferred embodiment according to the invention that thereafter the sealing and pressure-distributing film is applied to the girder profile and the piping profile(s) arranged therein. In the last process step the top profile is put onto the girder profile and fixed thereto, preferably by means of a screwed connection, in a manner that thereafter the top profile securely fastens against loss of the piping profile(s) in the receiving space(s) of the supporting profile.

Further details, characteristics and advantages of the invention result from the subsequent description of an example on the basis of the drawing.

BRIEF DESCRIPTION OF THE DRAWING

The only FIGURE of the drawing shows a cross section through a holding device 1 according to the invention.

DESCRIPTION OF THE PREFERRED EMBODIMENT

In the example shown in the FIGURE the holding device 1 according to the invention serves to anchor two two-layer webs 2, 3, which were made to become air cushions by pumping air into the webs. This kind of air cushions can e.g. be used to form an air-permeable and heat-insulating ceiling. Basically, however, the holding device 1 according to the invention is also suitable for anchoring single-layer webs or membranes, each of which is provided with a peripheral thickening still to be described in more detail below.

According to the particularly preferred embodiment as shown in the FIGURE, which in the example is designed to fix two cushions 2, 3, the holding device 1 according to the invention comprises two piping profiles 4, 5, one supporting profile 6 and one top profile 7, which is a preferred element in the shown embodiment.

In the example, supporting profile 6 comprises two receiving spaces 8 and 9 for the piping profile 4 or 5, said spaces being disposed symmetrically to the center axis M of the supporting profile 6. Between the receiving spaces 8 and 9 two grooves 10 and 11 are located. Groove 10 exhibits a rectangular receiving section 12 ending in an opening 13. In the receiving section 12 the head of a fastening screw can be located, the thread shaft of which extends through the opening 13 and is fixable to a primary structure not shown in the FIGURE. In a corresponding manner, the groove 11 is provided with a receiving section 14 and an opening 15 and serves to receive one or several screws for fixing the top profile 7.

At its two lateral edges the supporting profile 6 comprises bearing sections 16 and 17 to provide support at the primary structure. In upward direction, each of bearing sections 16 and 17 is connected to exterior border walls 18 and 19, respectively, which define the receiving spaces 8 and 9 together with interior border walls 20 and 21, respectively. At the upwardly pointing side of the FIGURE, each of the exterior border walls 18 and 19 comprises one of the clamping surfaces 22 and 23, respectively, which, as demonstrated in the FIGURE, point to a clamping surface 24 or 25 of the top profile 7. In the assembled state of the top profile 7 as indicated in the FIGURE, the pairs of clamping surfaces 22, 24 and 23, 25 form clamping means, the function of which will be explained further below.

The top profile 7 shows a substantially flat center area 26, at the lower side of which two bead-like thickenings 27 and 28 are provided, which in a fixed state rest on two horizontal legs 29 and 30 defining opening 15. In the edge areas 31 and 32, the top profile 7 is extended in downward direction and increased in thickness, as shown in the FIGURE.

Between the beads 27 and 28 recesses are provided for the screwed connection for fixing the top element 7, which recesses, however, are not shown in the FIGURE in detail.

The two piping profiles 4 and 5 are of identical shape, so that in the following merely piping profile 4 is referred to for explaining the structure.

As shown in the FIGURE, piping profile 4 is dimensioned such that when arranged in the receiving space 8 there remains a gap between the piping profile 4 and the interior border wall 20, wherein a locking plate 33 or 34 can be arranged at the other side. Said locking plate serves to prevent, at least temporarily, the piping profiles from falling out, in particular before the top profile 7 has been arranged.

The shape of the piping profile 4 of the embodiment shown in the FIGURE results from the drawing, to which explicit reference is made for the purpose of disclosure and because of the relatively complicated shaping. In detail, the piping profile 4 comprises a substantially rectangular base body 35, wherein a retaining recess 36 is provided. To said base body 35 an L-shaped leg 37 is connected, which has a substantially horizontal area and a substantially vertical section adapted to the slight slope of the exterior wall 18. As shown in the FIGURE, the piping profile 4 rests on the floor of the receiving space 8 with the foot 38 of area 37 and with a supporting surface 39 of the main body. The retaining recess 36 is connected with a funnel-shaped guiding section 40 and in the upper section of the main body 35 a groove 41 is provided as mounting aid, e.g. for inserting the piping profile 4 into the receiving space 8.

As shown in the FIGURE, a peripheral thickening 42 of cushion 2 is inserted into the retaining recess 36. The peripheral thickness 42, also called piping, merges into a welded seam area 43, which is fixed by clamping means 22, 24 when the top profile 7 is assembled, so that the peeling effect on the welding seam area 43 produced by the air pressure is being compensated.

In the particularly preferred embodiment shown in the FIGURE. there is also provided a sealing and pressure-distributing film 44, which is attached to the girder profile prior to the attachment of top profile 7 and after the insertion of the piping profiles 4 and 5, thus achieving that above all the area of cushions 2 and 3 located in the clamping means is covered and sealed.

As demonstrated in the FIGURE, piping profiles 4 and 5 are dimensioned and shaped such that, in particular after the arrangement of locking plates 33 and 34, they rest on the interior border walls 20 and 21 and the exterior border walls 18 and 19 via said locking plates 33 and 34. In order to increase the security against loss, the top profile 7 is fixed at the girder profile 6 after the piping profiles 4 and 5 have been arranged. For inserting the peripheral thickness 42 the piping profiles 4 and 5 are slided onto pipings 42 in the longitudinal direction of said pipings 42, with the funnel-shaped area 40 connected to the retaining recess serving to guide the edge area of cushion 2 and 3. It is self-evident that the funnel area 40 dimensioned such that a sliding out of the peripheral thickening in the direction of funnel 40 is prevented.

A further advantage of the holding device 1 according to the invention to be mentioned is that all profiles 4, 5, 6 and 7 are bendable, thus allowing them to be formed according to the shape of the primary structure. With the holding device 1 according to the invention there can also be fixed any optionally shaped cushion and kind of web. It is preferred that the front faces of the receiving spaces of supporting profile 6 are closed, e.g. by providing front walls, which are not shown in the FIGURE.

We claim:

1. A holding device for the anchorage of single- or multi-layered webs, preferably of air-filled cushions, to a stationary structural member, comprising:

a piping profile configured to receive a peripheral thickening of the web; and a supporting profile that can be attached to the structural member and to which the piping profile can be fixed wherein the supporting profile comprises a receiving space for the piping profile;

a top profile closing the receiving space;

a locking plate between the piping profile and an adjacent interior border wall of the supporting profile to temporarily lock the piping profile in the receiving space; and a clamp arranged adjacent to the receiving space which, in a mounted state of said piping profile, is configured to support a welding seam area of a double-layer web fixed in the piping profile;

wherein said clamp is formed by two clamping surfaces arranged one on top of the other, the one clamping surface is arranged on an exterior border wall of the receiving space and the other clamping surface is arranged at the top profile.

2. An anchorage system comprising:

a web having a peripheral thickening along at least one edge thereof;

a piping profile having a recess which conforms to the peripheral thickening of the web and into which the peripheral thickening of the web is received and secured;

a supporting profile that can be attached to a structural member and into which the piping profile can be fixed;

wherein the supporting profile comprises a receiving space for the piping profile;

a top profile enclosing the receiving space;

a clamp arranged adjacent to the receiving space, which in a mounted state of the piping profile, supports a welding seam area of a double-layer web fixed in the piping profile;

wherein the clamp is formed by two clamping surfaces one clamping surface is arranged on top of the other clamping surface, the one clamping surface is arranged on an exterior border wall of the receiving space and the other clamping surface is arranged at the top profile.

3. The anchorage system of claim 2, further comprising a locking plate between the piping profile and an adjacent interior border wall of the supporting profile to temporarily lock the piping profile in the receiving space.

4. The anchorage system of claim 2, further comprising a film for sealing and distributing pressure between the supporting profile and the top profile.

5. The anchorage system of claim 2, wherein the supporting profile can be fixed to the structural member by a screwed connection.

6. The anchorage system of claim 2, wherein the supporting profile comprises two receiving spaces arranged symmetrically to its center line.

7. An anchorage system for securing a web having a peripheral thickening comprising:

an elongated support profile configured to be fastened to a structural member, the support profile having a recess along the length thereof;, an elongated piping profile received within the recess and extending longitudinally therein, the piping profile having a retaining cavity configured to secure the peripheral thickening therein;

a top profile affixed to the support profile with the elongated piping profile captured therebetween; and a clamp arranged adjacent to the recess which in a mounted state of the elongated piping profile, supports a welding seam area of a double-layer web fixed in the piping profile, wherein the clamp is formed by two clamping surfaces one clamping surface is arranged on top of the other clamping surface, the one clamping surface is arranged on an exterior border wall of the recess and the other clamping surface is arranged at the top profile.

8. The anchorage system of claim 7, wherein the cavity has a mouth and the top profile closes the mouth to secure the peripheral thickening of the web.

9. The anchorage system of claim 8, further comprising a locking plate between the piping profile and an adjacent interior border wall of the support profile to temporarily lock the piping profile in the recess.

10. The anchorage system of claim 8, further comprising a film for sealing and distributing pressure between the support profile and the top profile.

11. The anchorage system of claim 8, wherein the support profile can be fixed to the structural member by a screwed connection.

12. The anchorage system of claim 8, wherein the recess along the length of the support profile comprises two receiving spaces arranged systemically to its center line.

* * * * *